United States Patent [19]

Ninio et al.

[11] Patent Number: 4,881,463

[45] **Date of Patent: * Nov. 21, 1989**

[54] ELECTRIC IGNITER ASSEMBLY

[75] Inventors: Jacob Ninio, Tel-Aviv; Jacob Baratz, Kfar Saba; Haim Moshe, Hod Hasharon, all of Israel

[73] Assignee: The State of Israel, Ministry of Defence, Israel Military Industries, Israel, Israel

[ * ] Notice: The portion of the term of this patent subsequent to Sep. 20, 2005 has been disclaimed.

[21] Appl. No.: 186,451

[22] Filed: Apr. 26, 1988

[30] Foreign Application Priority Data

Feb. 24, 1988 [IL] Israel ..... 85527

[51] Int. Cl.[4] ..... F42B 3/18; F42C 19/12

[52] U.S. Cl. ..... 102/202.2; 102/202.5

[58] Field of Search ..... 102/202.2, 202.5, 202.9, 102/202.14, 472

[56] References Cited

U.S. PATENT DOCUMENTS

| | | | |
|---|---|---|---|
| 2,696,191 | 12/1954 | Sheehan | 102/202.9 |
| 3,682,096 | 8/1972 | Ludke et al. | 102/202.9 |
| 3,763,782 | 10/1973 | Bendler et al. | 102/202.9 |
| 3,906,858 | 9/1975 | Craig et al. | 102/202.9 |
| 4,353,304 | 10/1982 | Hubsch et al. | 102/202.14 |
| 4,625,645 | 12/1986 | Williams | 102/202.5 |
| 4,690,056 | 9/1987 | Brede et al. | 102/202.2 |
| 4,771,692 | 9/1988 | Ninio et al. | 102/202.2 |

FOREIGN PATENT DOCUMENTS

| | | | |
|---|---|---|---|
| 3502526 | 8/1985 | Fed. Rep. of Germany | 102/202.2 |

*Primary Examiner*—Charles T. Jordan

*Attorney, Agent, or Firm*—Steinberg & Raskin

[57] ABSTRACT

An electric igniter assembly for igniting an initiator charge in artillery ammunition. The initiator charge is enclosed within a chamber sealed at one end by an electrical ignition element comprising two conductors linked by means of an electrically resistive bridge, one of which conductors is in permanent electrical contact with a DC supply terminal and the other of which is connected to a contactor block comprising an aluminium body having part of its surface covered by an aluminium oxide coating, thereby permitting contact with a complementary DC supply terminal, so as to complete the circuit through the resistive bridge which glows, thereby sparking off the initiator charge. The novel igniter assembly features a relatively low margin between the values of current intensities for "NO FIRE" and "ALL FIRE" whilst at the same time avoiding electromagnetic radiation hazards (HERO).

4 Claims, 3 Drawing Sheets

FIG. 3
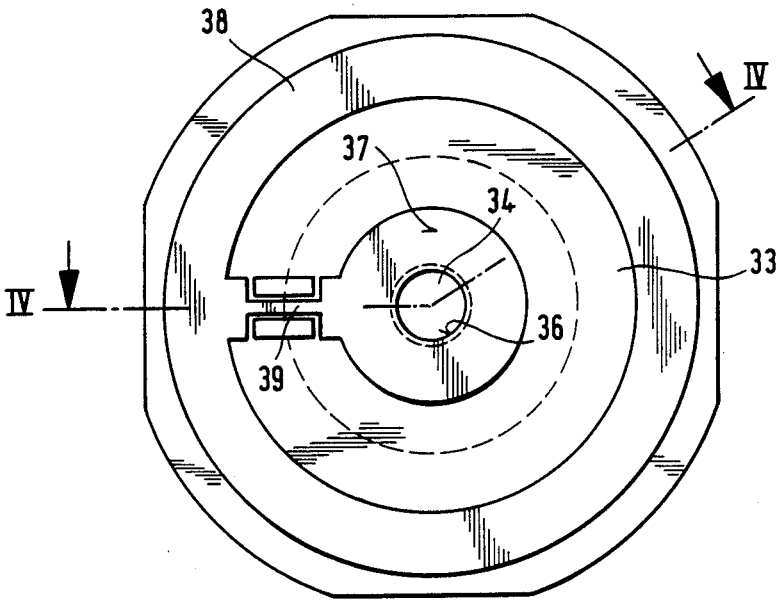
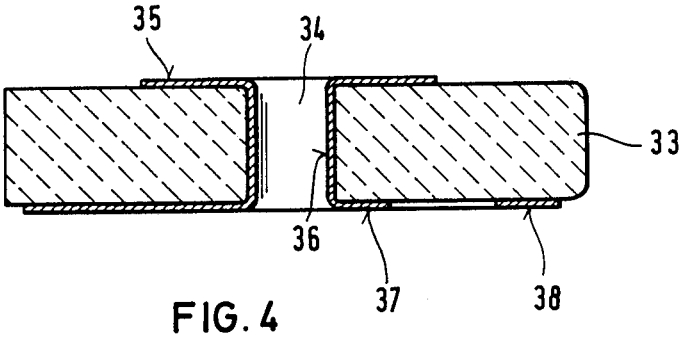
FIG. 4

ELECTRIC IGNITER ASSEMBLY

FIELD OF THE INVENTION

The present invention concerns an electric igniter assembly for the ignition of a primer charge in ammunition. In particular, the electric igniter assembly according to the invention is suitable for use in ammunition for flat trajectory artillery such as tank guns.

BACKGROUND OF INVENTION AND PRIOR ART

Quite generally, an electric igniter for artillery ammunition serves to ignite the primer charge of such ammunition. It comprises a metal casing holding an initiator charge associated with an electric resistor. The resistor is permanently electrically linked to one of the two terminals of a DC source via said casing and is further electrically linked to a contactor which is insulated from the casing and connectable at will with the other terminal of said DC source. Upon the establishment of such contact, the electric resistor is heated whereby said initiator charge is ignited and ignites in turn said primer charge, usually via a booster charge.

By one known method, the initiator charge is intimately mixed witha particulate electric conductor material such as, for example, graphite powder or a metal powder while by another known method an electric wire of such resistance that it glows upon the passage of the design current therethrough extends in contact with the initiator charge.

Both these methods suffer from relatively high spreads of the ignition time and from relatively long ignition times, or less than optimum trade-off of both ignition time and safety. These drawbacks give rise to serious disadvantages which may become prohibitive in modern computerized gunnery.

To overcome some of these problems there have been designed and there are known electric igniters of the kind specified which comprise an electric ignition element in the form of an insulating carrier body, for example of ceramic material, bearing two electric conductors linked by a resistor bridge. In such elements said conductors and bridge are applied to the carrier body by known techniques such as printing or thin layer application.

In modern battle fields there prevails an abundance of electromagnetic radiation, mainly in consequence of telecommunications and radar of various kinds. This radiation gives rise to hazards referred to in the art as HERO (Hazards of Electromagnetic Radiation to Ordnance) in that it induces in the igniters via said contactor spontaneous radio frequency (RF) currents liable to initiate explosion of the ammunition. It has accordingly been realized before that special means are required in order to suppress the formation of induction currents in said igniters. A solution of the problem is described in German Patent specification DE-Al-3502526. In accordance with that disclosure, the imprinted or applied circuit of an electric ignition element is shaped in a complicated tortuous form so as to constitute itself a high frequency filter in consequence of its own increased inductance and capacitance. However, apart from the fact that the formation of the required complicated conductor patterns in such elements is relatively costly, it has been found that such igniters are inapplicable to armoured vehicle artillery. In such vehicles the voltage supply is inherently low and by some standards ignition at 2.1 amp is required. On the other hand because of HERO hazards there should be no firing at 1 amp and this leaves a rather narrow margin of 1.1 amp between NO FIRE and ALL FIRE. It is thus one object of the present invention to provide a reliable electric igniter assembly of the kind specified in which the margin between the current intensities for "NO FIRE" and "ALL FIRE" can be kept low while the HERO hazards are strictly avoided.

It is a further object of the present invention to provide an electric igniter assembly of the kind specified which affords safety against spontaneous initiation in consequence of static electric discharge from the operator.

A further problem encountered in artillery ammunition with an electric igniter assembly of the kind specified are hazards resulting during a firing cycle from rearward bursting combustion gases whilst the ammunition is still in the barrel. These gases penetrate the electric igniter assembly via the voids left in consequence of the combustion of the initiator and booster charges and may deform the base portion of the igniter to an extent that it will interfere with the extraction of the empty shell and accordingly also with the reloading of the gun and give rise to malfunctioning of the firing system. It is therefore a further object of the present invention to overcome this problem and provide an electric igniter assembly of the kind specified in which any rearward bursting combustion gases or materials are prevented from reaching the assembly's base portion.

SHORT DESCRIPTION OF THE INVENTION

With these objects in view, the invention provides an electric igniter assembly of the kind that comprises a body holding an initiator charge and in association therewith an electric ignition element comprising an insulating carrier member bearing two electric conductors insulated from each other and interconnected by an electric resistor bridge, one of which conductors is permanently electrically linked with one of two terminals of a DC source while the other is electrically linked to a contactor connectable at will to the other of said terminals, characterized in that said contactor comprises an aluminium body having part of its surface covered by an aluminium oxide coating that serves as electric insulator, and further characterized by the provision of an intermediary electric conductor member designed as a radio frequency (RF) filter and comprising a pin electrically linked to said contactor and a block enclosed within an insulating sheath and electrically linked to said electric ignition element, which block comprises a conical portion adjacent to said pin tightly fitted onto a correspondingly shaped seat in said body thereby being designed as a stopper preventing any backflowing combustion gases or materials from reaching the base portion of the igniter assembly.

In the electric igniter assembly according to the invention the contactor together with the intermediary electric conductor provide an effective RF filtering effect that protects against electromagnetic radiation and they further provide a capacitance which ensures that discharge of static electricity from the operator does not trigger off an ignition. The RF filtering effect of the intermediary electric conductor is based on the so-called 'L' type filter. The constituents of this filter area an inductor (the pin) and a capacitor (the core). At high frequencies (RF) the pins act as an inductor due to the so-called skin effect whereby currents can flow only from the surface region, i.e. the 'skin' of the pin. In consequence of such skin effect, the intermediary electric conductor has a relatively high self-inductance.

If desired, the self-inductance of the pin can be increased by surrounding it with ferrite.

The block component of the intermediary electric conductor provides an electric capacitance which further contributes to the RF filtering effect of the intermediary conductor. It was shown that the overall RF filtering effect of the intermediary electric conductor is so pronounced that the electric igniter assembly according to the invention is safe against RF induced ignition which enables the design of the igniter assembly with a low current tolerance, i.e. low margin between the current intensities of "NO FIRE" and "ALL FIRE". It is then possible in accordance with the invention to provide electric igniter assemblies that meet the standards set for the margin between "NO FIRE" and "ALL FIRE" in tank artillery, which in one specific case should be of the order of 1.1 amp.

It has further been found in accordance with the invention that the block of the intermediary electric conductor acts as a capacitance shunting the discharge into the electric ignition element of any static electricity from the person handling the ammunition.

The conical portion of the block in conjunction with the sheath serves as a stopper preventing any rearward bursting combustion gases and hot particles from reaching the base portion of the igniter assembly. In this way any deformation of the base portion, which if it were to occur would interfere with the discharge of the empty shell and damage the firing system, is avoided.

It has, moreover, surprisingly been found in accordance with the present invention that the aluminium contactor with aluminum oxide coating augments the RF filtering capacity of the system. It also forms a capacitor that affords protection against spontaneous initiation in consequence of a static discharge from the operator. In both its capacities of RF filtering and the capacitor, the anodized aluminium contactor provided in accordance with the invention is superior to conventional contactors comprising a metal block within an insulating sheath or envelope.

DESCRIPTION OF THE DRAWINGS

For better understanding the invention will now be described, by way of example only, with reference to the annexed drawings in which:

FIG. 3 is a plane view of the electric ignition element in the assembly of FIG. 2, drawn to a larger scale; and FIG. 4 is a section along line IV-IV of FIG. 3.

DESCRIPTION OF A SPECIFIC EMBODIMENT

Figure 1:
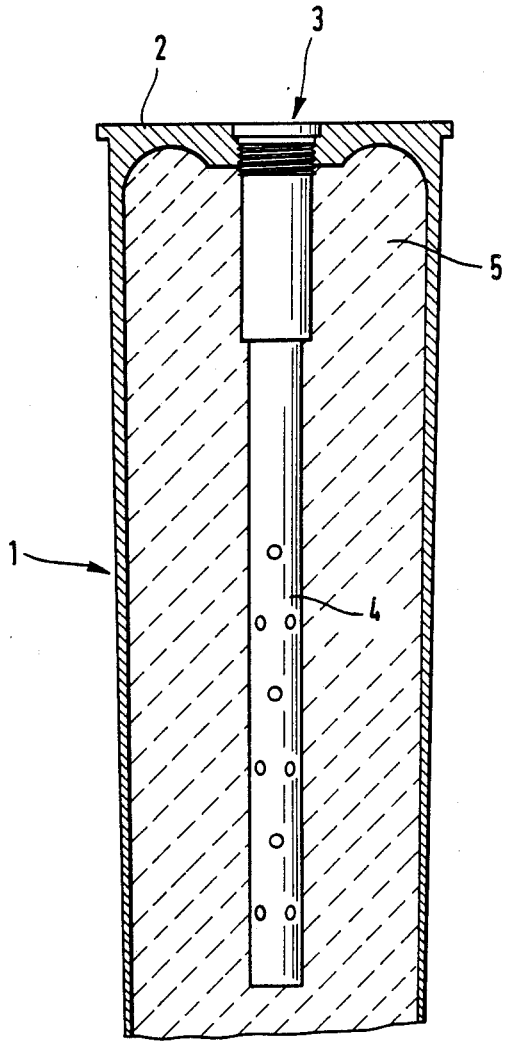
FIG. 1 is a fragmentary axial section of a cartridge fitted with an electric igniter assembly according to the invention.

The manner in which an electric igniter assembly is fitted into a round of artillery ammunition is illustrated in FIG. 1. As shown, a cartridge 1 has a base sealing plate 2 accommodating an electric igniter assembly 3 which is located within the wider portion of cartridge 1. Igniter assembly 3 is aligned with a perforated tube 4 holding an ignition charge while the space of cartridge 1 surrounding the perforated tube 4 holds a propellant charge 5. For electric ignition, an electric terminal (not shown) is contacted with a contactor inside the electric igniter assembly 3 whereupon an initiator charge within assembly 3 is ignited which in turn causes the ignition of the ignition charge within perforated tube 4 via a booster charge in the igniter assembly. The ignition charge then ignites the propellant charge 5 whereupon the shell is hot out of the gun's barrel.

Figure 2:
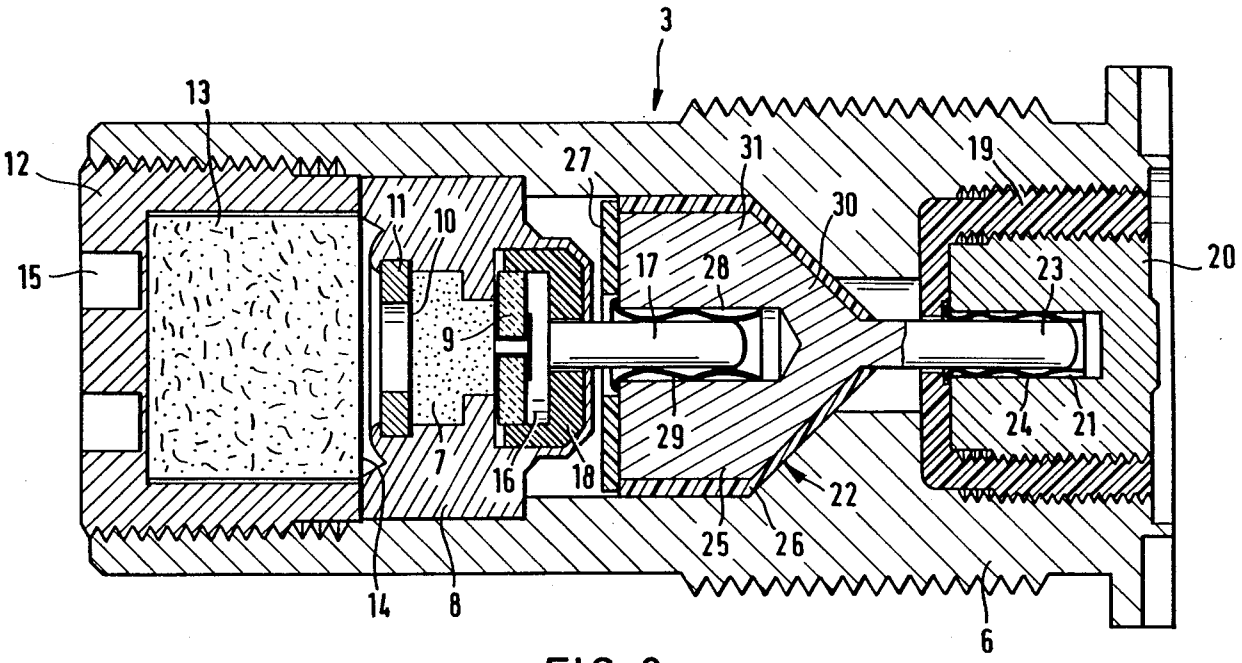
FIG. 2 is an axial section through an electric igniter assembly according to the invention.

In FIG. 2 the electric igniter assembly 3 of FIG. 1 is drawn to a larger scale. As shown it comprises a cylindrical metal body 6 holding an initiator charge 7 enclosed within a metal sleeve 8 and sealed at the rear by an electric ignition element 9 and at the front by a metal membrane 10 supported by a ring 11. A plug 12 holding a booster charge 13 is screwed into the head portion of body 6 in front of the initiator charge 7. The rear side of booster charge 13 is sealed by means of a metal or paper membrane 14 clamped between sleeve 8 and plug 12 and on the front side of booster charge 13 there are provided bores 15 through which the combustion from the booster charge bursts into tube 4 (see FIG. 1) to ignite the ignition charge therein.

Associated with the electric element 9 and permanently bearing on the rear face thereof is a contactor disc 16 (not sectioned in FIG. 2) having an integral electrode 17 and being enclosed within an insulating cap 18.

An aluminium contactor comprising an aluminium block 19 partly coated with an aluminium oxide coating 20 that serves as insulator, is screwed into a threaded socket in the rear portion of body 6. Contactor block 19 comprises a socket 21.

Between the electric ignition element 9 with its associated contactor-electrode assembly 16, 17 and the contactor block 19, 20, the electric igniter assembly according to the invention shown in FIG. 2 comprises an intermediary electric conductor member 22. Conductor member 22 comprises a pin 23 received within socket 21 of block 19 with the interposition of a tubular contact spring 24, and a block 25 covered by an insulating sheath 26, e.g. of soft plastic material, and an insulating front plate 17. Block 25 comprises a socket 28 receiving the electrode 17 with the interposition of a tubular contact spring 29. Adjacent pin 23 block 25 of the intermediary electric conductor member 22 comprises a conical section 30 which merges into a cylindrical section 31.

The design of the electric ignition element 9 is more closely shown in FIGS. 3 and 4. As shown, the element comprises an insulating carrier body 33, e.g. of ceramic material having a central bore 34. The carrier body 33 bears a first electric conductor comprising a first annular portion 35 applied to the rear face of body 33, i.e. the one that in FIG. 2 faces the contactor disc 16; a tubular portion 36 that lines bore 34; and a second annular portion 37 located on the front side of carrier body 33, i.e. the side which in FIG. 2 faces the initiator charge 7. The front side of carrier body 33 further bears a second, annular conductor 38 and a bridge 39 that links the second conductor 38 with the annular portion 37 of the first conductor 35, 36, 37.

The conductors 35, 36, 37 and 38 as well as the bridge 39 are applied to the ceramic carrier body 33 by known techniques such as printing or thin-layer application. By these techniques, specific geometries are precisely reproduced which means that in the production of a desired type of an electric ignition element the electric characteristics of the conductor and the bridge are precisely reproduced with the result that all ignition elements have practically the same short ignition time.

As can be seen from FIG. 2, conductor 38 of FIG. 3 is permanently in contact with the metallic sleeve 8 which in turn is in contact with the metallic casing 6, the latter being in contact with the metallic sealing plate 2 of wheel 1 (see Fig. 1). The breech of the gun with which the sleeve of a loaded round of ammunition is in contact is permanently linked to one of the two terminals of a DC supply, e.g. the storage battery of a tank's engine, as known per se, and in consequence of this chain of electric linkages conductor 38 is permanently linked to one of two DC terminals.

As is further seen from FIG. 2, component 35 of the first conductor 35, 36, 37 is permanently in contact with contactor disc 16 and accordingly with contactor 19, 20 via a chain of links which comprises electrode 17, contact spring 29, block 25, pin 23 and contact spring 24. Accordingly, each time contactor 19 is contacted with the second terminal of said DC source, electric current is caused to flow through bridge 39 which beings to glow whereby the initiator charge 7 is sparked off and the ammunition is fired. Any rearward bursting combustion gases that penetrate into the fired igniter assembly 3 via the voids left in consequence of the combustion of the initiator charge 7 and booster charge 13, are stopped by block 25 of the intermediary electric conductor member 22 in that by the pressure of the combustion gases the conical portion 30 with the corresponding portion of sheath 26 is pressed onto its seat whereby any passage is sealed off and any deformation of the base portion of the igniter assembly by rearward bursting combustion gases is prevented. It is thus seen that the intermediary electric conductor member 22 acts as a stopper to block the rearward flow of combustion gases.

Due to the inductance of pin 23 which results from the skin effect thereof, and the capacity of block 25, the intermediary electric conductor member 22 acts as an effective low pass RF filter suppressing a wide band of radio frequencies including all the frequencies that are used for telecommunication and other intentional RF emitters and in this way the so-called HERO effects are greatly reduced. Further RF filtering is achieved by the aluminium contactor 19 with its aluminium oxide coating 20.

Finally, the capacitance of block 25 and contactor 19 ensure that discharge of static electricity from the operator does not trigger off an ignition.

It is thus seen that the electric igniter assembly according to the invention in addition to providing safety against hazardous effects of rearward bursting combustion gases, also meets all the requirements for use in conjunction with artillery ammunition in general and tank artillery ammunition in particular, in that it provides a high degree of safety against spontaneous ignition by an RF induced electric current or an electric current resulting from the discharge of static electricity from the operator. Consequently, the invention makes it possible to design the electric igniter assembly with a narrow margin of say about 1.1 amp. betwen "NO FIRE" and "ALL FIRE". This may, for example, be achieved by selecting the thermal coefficient so that the electric ignition element 9 is not ignited by a current of about 1 amp. and a power input of about 1 watt, but is ignited by a current of not less than about 2.1 amp. in a predetermined, precise timing.

If desired, the self-inductance of pin 23 may be increased by surrounding it with ferrite, e.g. by embedding the pin in a ferrite bead.

The aluminium contactor 19, 20 may be produced by conventional anodization techniques such as, for example, the technique known as hard anodic coating. Such techniques are well known in the art.

The thickness of the $Al_2O_3$ layer of the contactor 19, 20 is not critical. By way of example it may be within the range of from 50–100 $\mu$.

We claim:

1. An electric igniter assembly of the kind that comprises a body holding an initiator charge and in association therewith an electric ignition element comprising an insulating carrier member bearing two electric conductors insulated from each other and interconnected by an electric resistor bridge, one of which conductors is permanently electrically linked with one of two terminals of a DC source while the other is electrically linked to a contactor connectable at will to the other of said terminals, the improvement by which said contactor comprises an aluminium body having part of its surface covered by an aluminium oxide coating that serves as electric insulator, and further characterized by the provision of an intermediary electric conductor member designed as a radio frequency (RF) filter and comprising a pin electrically linked to said contactor and a block enclosed within an insulating sheath and electrically linked to said electric ignition element, which block comprises a conical portion adjacent to said pin tightly fitting onto a correspondingly shaped seat in said body thereby being designed as a stopper preventing any backflowing combustion gases or materials from reaching the base portion of the igniter assembly.

2. An electric igniter assembly according to claim 1, wherein the electric characteristics of said electric ignition element are so selected that a current of about 1 amp. and a corresponding power input of about 1 watt does not ignite the initiator charge.

3. An electric igniter assembly according to claim 1, wherein the electric characteristics of said electric ignition element are determined by selection of the thermal time coefficient whereby a current of about 2.1 amp. ignites the initiator charge.

4. An electric igniter assembly according to claim 1, wherein said pin of said intermediary electric conductor is surrounded with ferrite.

* * * * *